US012281554B2

(12) United States Patent
Xia et al.

(10) Patent No.: US 12,281,554 B2
(45) Date of Patent: Apr. 22, 2025

(54) STIMULATING WELLS CREATED BY UNDERBALANCED COILED TUBING DRILLING

(71) Applicant: Saudi Arabian Oil Company, Dhahran (SA)

(72) Inventors: Kaiming Xia, Dhahran (SA); Todd Allen Green, Dhahran (SA); Tariq Mahmood, Dhahran (SA); Saidi Ali Hassani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/338,008

(22) Filed: Jun. 20, 2023

(65) Prior Publication Data

US 2024/0426199 A1 Dec. 26, 2024

(51) Int. Cl.
*E21B 43/114* (2006.01)
*E21B 43/26* (2006.01)
(Continued)

(52) U.S. Cl.
CPC ..... *E21B 43/26* (2013.01); *E21B 43/114* (2013.01); *E21B 49/006* (2013.01); *E21B 21/085* (2020.05);
(Continued)

(58) Field of Classification Search
CPC .... E21B 43/26; E21B 43/114; E21B 2200/20; E21B 49/006; E21B 33/138
See application file for complete search history.

(56) References Cited

U.S. PATENT DOCUMENTS 4,476,932 A 10/1984 Emery
7,503,404 B2 3/2009 McDaniel et al.
(Continued)

OTHER PUBLICATIONS

Garzon et al., "First Successful Selective Stimulation with Coiled Tubing, Hydrajetting Tool, And New Isolation Sleeve in An Openhole Dual-Lateral Well Completed in A Saudi Arabia Carbonate Formation: A Case History," SPE-130512-MS, The proceeding of the SPE/ICOTA Coiled Tubing and Well Intervention Conference and Exhibition held in The Woodlands, Texas, Mar. 23, 2010, 24 pages.
(Continued)

*Primary Examiner* — Taras P Bemko
(74) *Attorney, Agent, or Firm* — Fish & Richardson P.C.

(57) ABSTRACT

A bottom hole assembly (BHA) includes components to perform a fracturing process for small hole wells created by underbalanced coiled tubing drilling. The BHA can be used to drill a wellbore and to stimulate an underbalanced coiled tubing drilled well. The BHA, coupled to a coiled tubing, can include a drilling bit, a hydrajetting tool up-string from the drilling bit, and a diverter between the drilling bit and the hydrajetting tool. After the BHA drills a wellbore, the BHA can be moved so that the hydrajetting tool is positioned to perform perforation without removing the BHA from the wellbore. The hydrajetting tool can perforate the formation using a regular perforation fluid first, then using a cooling agent to cool the wellbore area covering the coplanar perforation cluster, and last propagate hydraulic fracture by injecting the main pump schedule through the tubing and the annulus at the same time.

19 Claims, 10 Drawing Sheets

(51) Int. Cl.
*E21B 49/00* (2006.01)
*E21B 21/08* (2006.01)
*E21B 33/138* (2006.01)

(52) U.S. Cl.
CPC ..... *E21B 33/138* (2013.01); *E21B 2200/20* (2020.05)

(56) References Cited

U.S. PATENT DOCUMENTS

| | | | | |
|---|---|---|---|---|
| 8,082,105 | B2 | 12/2011 | Ryu et al. | |
| 8,104,539 | B2 | 1/2012 | Stanojcic et al. | |
| 11,215,011 | B2 | 1/2022 | Ayub | |
| 2005/0230107 | A1* | 10/2005 | McDaniel | E21B 43/25 166/249 |
| 2008/0078548 | A1* | 4/2008 | Pauls | C09K 8/68 166/280.1 |
| 2009/0070043 | A1* | 3/2009 | Ryu | E21B 43/2605 73/152.13 |
| 2016/0053597 | A1* | 2/2016 | Brown | E21B 43/26 166/308.1 |
| 2021/0246780 | A1* | 8/2021 | Munir | E21B 47/06 |
| 2021/0348493 | A1* | 11/2021 | Aziz | E21B 7/04 |
| 2022/0106866 | A1 | 4/2022 | Wang et al. | |
| 2022/0113447 | A1 | 4/2022 | Xia et al. | |
| 2022/0154566 | A1* | 5/2022 | Aidagulov | E21B 43/26 |
| 2023/0064121 | A1 | 3/2023 | Xia et al. | |
| 2024/0070346 | A1 | 2/2024 | Xia et al. | |

OTHER PUBLICATIONS

Gu et al., "Hydraulic fracture crossing natural fracture at nonorthogonal angles: a criterion and its validation," SPE-139984, The Proceedings of The SPE Hydraulic Fracturing Technology Conference and Exhibition, The Woodlands, TX, Jan. 2011,7 pages.

Malik et al., "Advanced HPCT Abrasive Perforating Technique Utilized to Successfully Bypass Damaged Formation to Allow for Effective Acid Stimulation," IPTC 17698, Proceedings of International Petroleum Technology Conference, Doha, Qatar, Jan. 20-22, 2014, 9 pages.

Surjaatmadja et al., "Hydrajet Fracturing: An Effective Method for Placing Many Fractures in Openhole Horizontal Wells," SPE 48856, Proceedings of the SPE International Conference and Exhibition, Beijing, China. Nov. 2-6, 1998, 263-268, 6 pages.

Vasudevan et al., "Hydraulic fracturing: Coulomb failure stress in fracture networks," CSEG Recorder. Nov. 2011, 6 pages.

Xia, et al., "Injecting Cooling Agents to Reduce Breakdown Pressure for Open Hole Hydraulic Fracturing Treatment," Aramco Journal of Technology, Winter Session, 2021, pp. 45-53, 9 pages.

Zhang et al., "A study of shear hydraulic fracture propagation," Proceedings of the 6th North America Rock Mechanics Symposium (NARMS): Rock Mechanics across Borders and Disciplines, Jun. 2004, Houston, TX, American Rock Mechanics Association, 10 pages.

Zhang et al., "The Shear Mechanisms of Natural Fractures during the Hydraulic Stimulation of Shale Gas Reservoirs," Materials, 2016, 9, 15 pages.

* cited by examiner

STIMULATING WELLS CREATED BY UNDERBALANCED COILED TUBING DRILLING

TECHNICAL FIELD

This disclosure applies to stimulating wells created by underbalanced coiled tubing drilling (UBCTD).

BACKGROUND

Hydrocarbons are trapped in deep and tight formations of the Earth. Wellbores are drilled by a drilling assembly through those formations. The wellbores conduct the hydrocarbons to the surface. A wellbore can include a main wellbore extending from a surface of the Earth downward into the formations of the Earth containing the water, oils, and hydrocarbons. The main wellbore can include multiple lateral branches extending from the main wellbore.

SUMMARY

The present disclosure describes techniques that can be used for stimulating a well created from underbalanced coil tubing drilling (UBCTD), which can involve a smaller open hole diameter, around 4 inches. UBCTD herein can also involve multiple lateral branches extending from the main wellbore. This disclosure describes hydraulic fracturing tools used to stimulate the UBCTD wells.

Aspects of the embodiments include a bottom hole assembly for drilling and stimulating an underbalanced coiled tubing drilled well, the bottom hole assembly coupled to a coiled tubing, the bottom hole assembly including a drilling bit residing at the end of the bottom hole assembly; a hydrajetting tool up-string from the drilling bit, the hydrajetting tool to jet fluid to generate a perforation in the formation, and thereafter to slowly jet a cooling agent to cool the wellbore area that includes the perforation cluster; and a diverter substructure between the drilling bit and the jetting tool, the diverter substructure is used to prevent fluid from flowing to the drilling bit during the perforation. In some embodiments, creating a perforation includes creating a perforation cluster. In some embodiments, a perforations cluster can include two or more perforations. In some embodiments, a perforation cluster can include two or more coplanar or substantially coplanar perforation clusters. In this disclosure, a location where a perforation is formed is also a location from where a hydraulic fracture is started and from where a hydraulic fracture propagates. In this disclosure, the perforation location can also refer to a corresponding fracturing location.

Aspects of the embodiments include a method performed by a bottom hole assembly for stimulating an underbalanced coiled tubing drilled well, the bottom hole assembly coupled to a coiled tubing, the method including drilling a wellbore in a formation using the bottom hole assembly, the bottom hole assembly including a drilling bit at a bottom end of the bottom hole assembly for drilling the wellbore, a jetting tool up-string from the drilling bit, and a diverter between the drilling bit and the jetting tool; positioning the jetting tool at a location in the wellbore to perform perforation in the formation; creating a perforation (which can be a perforation cluster) in the formation using the jetting tool by jetting a perforation fluid at a first temperature towards the formation; further creating sharp fractures from the just created perforation cluster by slowly jetting a cooling agent at a second temperature into the wellbore area covering the perforation (or perforation cluster), the second temperature much less than the first temperature; and propagating the fracture by injecting fracturing fluid downwards through the annulus and coiled tubing at the same time.

Aspects of the embodiments are directed to a system for stimulating an underbalanced coiled tubing drilled well, the system including a bottom hole assembly including a drilling bit residing at the end of the bottom hole assembly, the drilling bit for forming a wellbore, a hydrajetting tool up-string from the drilling bit, the hydrajetting tool to jet a fluid to form a coplanar perforation cluster in the formation, and thereafter to slowly jet a cooling agent to cool the wellbore area that includes the coplanar perforation cluster, and a diverter substructure between the drilling bit and the jetting tool, the diverter substructure is used to prevent fluid from flowing to the drilling bit during the perforating; and a surface structure to control the bottom hole assembly to stimulate the well using the jetting tool without extracting the bottom hole assembly after forming the wellbore.

In some embodiments, the jetting tool is to jet a fracturing fluid towards the wellbore to generate perforation cluster and propagate a hydraulic fracture into the formation.

In some embodiments, the jetting tool includes a hydrajet assembly.

In some embodiments, the hydrajet assembly includes a hydrajet port to eject fluid; and a hydrajet sleeve expose the hydrajet port to the wellbore formation.

In some embodiments, the coiled tubing is coupled to the bottom hole assembly to transmit the perforation fluid and the cooling agent to the jetting tool as well as fracturing fluid.

Some embodiments include a measurement while drilling (MWD) tool to take measurements of the formation during drilling, the measurements used, at least in part, to identify a location for forming a perforation (or perforation cluster) in the formation.

In some embodiments, the perforation fluid and the cooling agent are delivered to the jetting tool through the coiled tubing.

In some embodiments, the fracturing fluid for creating the fracture is delivered through an annulus formed by the coiled tubing and the wellbore.

Some embodiments include retreating the bottom hole assembly from the (small) wellbore while maintaining the enough pressure of the fracturing fluid within the annulus acting on the wellbore to keep borehole in good conditions.

Some embodiments include, prior to creating the perforation, controlling the diverter to isolate the drilling bit from fluid flowing to the jetting tool.

Some embodiments include, after propagating the fracture, moving the bottom hole assembly to a second location up-hole from the fracture; positioning the jetting tool at a location for creating another coplanar perforation cluster in the wellbore formation; and forming a chemical seal in the wellbore downhole above the previous fracturing stage, the chemical seal to isolate the previous fracture from fluids.

Some embodiments include creating a second perforation (or perforation cluster) using the jetting tool by jetting a perforation fluid towards the wellbore formation at the second location; creating sharp fractures by slowly jetting a cooling agent to cool the wellbore area covering the perforation cluster; and propagating hydraulic fracture by injecting fracturing fluid downwards through the annulus (between wellbore and tubing) and coiled tubing simultaneously.

Some embodiments include extracting information about the formation in a landing zone from the 3D geomechanics model; determining formation properties in the landing zone; and identifying each fracturing location along the wellbore in the landing zone based on the formation properties and in-situ stresses.

In some embodiments, identifying the perforation locations (also referred to fracturing locations) includes determining fracturing breakdown pressure along the wellbore in the landing zone; and identifying each fracturing location based on the breakdown pressure.

In some embodiments, identifying the perforation locations includes evaluating diagenetic rock typing along the wellbore at the landing zone; and identifying the location for each fracture based on the diagenetic rock typing.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. The bottom hole assembly can be used to create the wellbore and to stimulate the well without intermediate removal of the bottom hole assembly. This means that wellbore creation and well stimulation can be completed faster and using a single bottom hole assembly. All the functions will be executed in one downhole run. The UBCTD drilled laterals will be perforated and stimulated if the well does not produce naturally, which can be identified based on the geo-steering during drilling process.

For stimulating wells created by UBCTD, the BHA being stuck can be a potential issue. The systems and techniques described herein allow the BHA to be removed from the wellbore while the wellbore is pressured by the annulus fluid pressure. The fluid pressure inside the annulus allows the open hole to maintain stability and keep the open hole in good shape, which can allow the BHA smoothly trip out of the hole after stimulation.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

BRIEF DESCRIPTION OF THE DRAWINGS

Like reference numbers and designations in the various drawings indicate like elements.

DETAILED DESCRIPTION

Figure 1A:
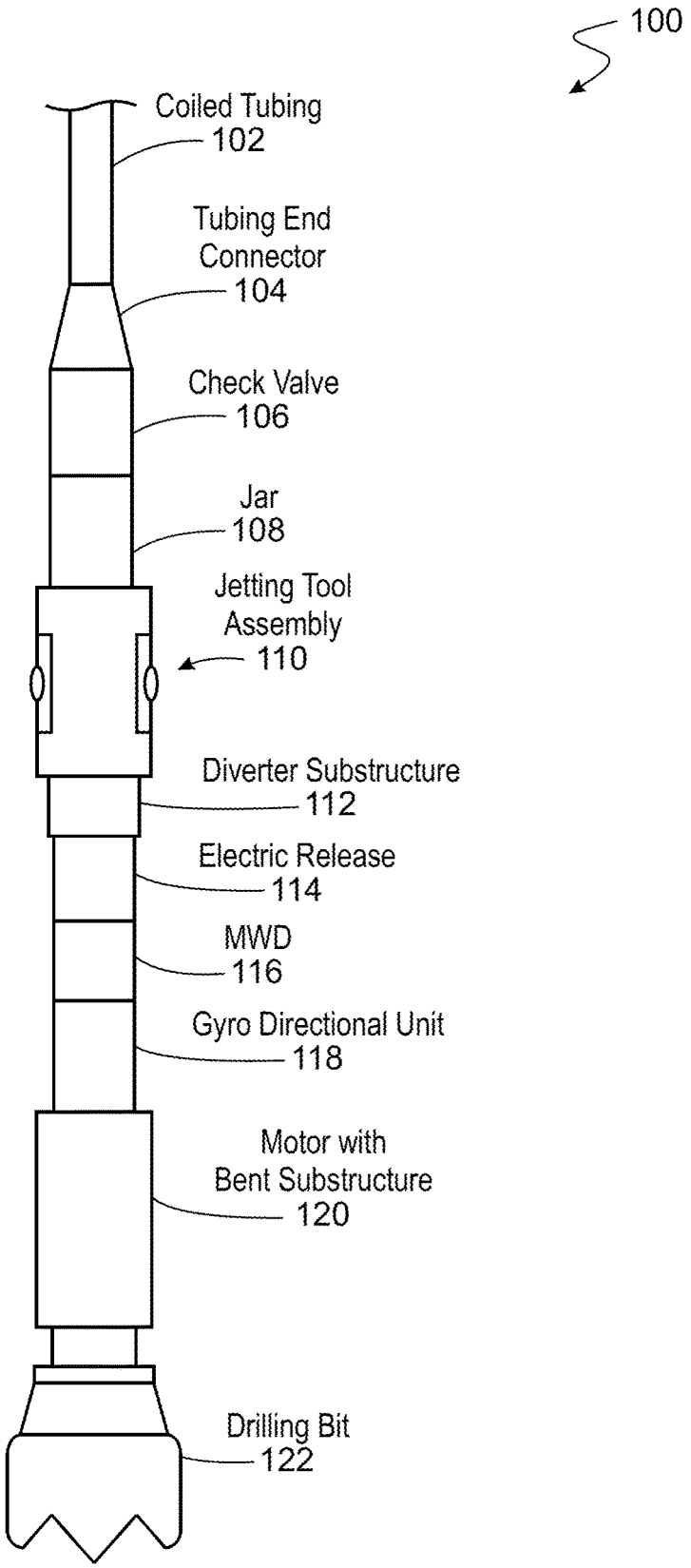
FIG. 1A is a schematic diagram of an example bottom hole assembly coupled to a coiled tubing in accordance with embodiments of the present disclosure.

The following detailed description describes techniques for stimulating a well created by underbalanced coil tubing drilling. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Drilling horizontal wells in deep and tight gas reservoirs can be very challenging, which faces very slow rate of penetration and fast abrasive wear of drilling bit as well. In this case, underbalanced coiled tubing drilling might be a good option if the reservoir rock can produce naturally after drilling. Underbalanced coiled tubing drilling (UBCTD) uses a small drilling bit size and allows for continuous drilling and pumping, which can increase the rate of penetration and avoid pipe differential sticking. It can minimize formation damage and increase production. However, some wells drilled by UBCTD cannot produce naturally after drilling. Stimulation is required to boost production. The question is how to stimulate the UBCTD wells which have a smaller hole diameter. To answer this question, this invention presents a novel fracturing process for stimulating UBCTD wells.

First, UBCTD utilizes active pressure control equipment at surface that allows for the well to flow naturally while drilling and reduces or eliminates formation damage to the reservoir caused by traditional drilling methods. Second, UBCTD uses a smaller size drilling bit compared to conventional drilling (e.g., less than 4 inches) and allows for continuous drilling and pumping while flowing the well. Third, UBCTD can increase the rate of penetration and avoid pipe differential sticking by flowing back while drilling. Last, UBCTD increases reservoir contact by created many additional laterals for improved production as well.

For UBCTD, the pressure in the wellbore is lower than the pore pressure in the formation being drilled (i.e., so-called, underbalanced). To minimize borehole breakout issues, the wellbore should be drilled at an optimal direction, which can be calculated based on mechanics principle. This allows reducing the drilling mud weight to as low as possible and to maintaining as high as possible wellbore stability.

Generally horizontal wells in deep and tight gas reservoirs will be stimulated for better well productivity. Due to the relatively smaller borehole diameter using UBCTD (e.g., around 4 inches), conventional hydraulic fracturing processes cannot be directly applied to stimulate UBCTD wells after drilling. For this reason, UBCTD has been reserved for certain reservoirs that are expected to produce naturally without stimulation after drilling, such as carbonate or sandstone, which have low clay content and good reservoir porosity and permeability. However, some wells drilled using UBCTD still cannot produce naturally after drilling.

This disclosure describes a bottom hole assembly (BHA) that includes a drilling tool and a jetting tool that can be used for drilling the wellbore and for fracturing and stimulation, in one downhole run. The BHA design can facilitate stimulation process for wells created by UBCTD, integrating the drilling and stimulating process into one continuous operation. Particularly the bottom hole assembly is designed to have the following capabilities: (1) drilling the lateral first; (2) then turn on the diverter to isolate the drilling bit and other down-string components from perforation fluid; (3) perforating the borehole using high pressure hydrajetting tools combined with normal temperature fluid or acid; (4) followed by slowly injecting cooling agents to cool the wellbore covering the already perforated locations for further cracking or sharp fracture; (5) finally injecting stimulation fluid at the regular pump schedule (a) through the coiled tubing or (b) through the coiled tubing and through the tubing annulus for fracture propagation. The fracturing procedure will be repeated stage after stage from toe to heel. All the fracturing processes will be executed in one downhole run.

The perforating and stimulating can be selectively applied if the well cannot produce naturally or with low production rate. These factors can be identified based on geo-steering during drilling process using information obtained from, e.g., measurement while drilling (MWD) tools.

A bottom hole assembly for stimulating underbalanced coiled drilling wells is described, which can integrate the drilling and stimulating processes in one downhole run. A fracturing process for stimulating underbalanced coiled tubing drilling wells is described.

The breakdown pressure for perforations and optimum perforation directions along the well trajectory can be calculated. Ideal fracturing locations can be identified, for easy fracture initiation and perforate using hydrajetting method at the optimum perforation directions.

A process for fracturing and stimulating under balanced coiled tubing drilling wells is described, which jets the normal temperature fluid first to generate the designed perforation shape, then slowly inject cooling agents to cool the wellbore area including the perforation cluster for generating additional sharp fracture tips. The process can include injecting cooling agents for initiating fractures at the fracturing locations and calculate the required time for cooling process. The process can also include injecting the regular pump schedule to complete the hydraulic fracturing treatment. A chemical plug is used for isolating fracturing stages.

FIG. 1A is a schematic diagram of an example bottom hole assembly 100 coupled to a coiled tubing 102 in accordance with embodiments of the present disclosure. For underbalanced coiled tubing drilling, the drilling bit diameter is relatively small (e.g., around 3.625 inches). In this situation, the conventional completion tools in the smaller downhole cannot be directly used for hydraulic fracturing treatment (e.g., larger tools can likely encounter tool sticking issue). FIG. 1A illustrates a bottom hole assembly (BHA) for underbalanced coiled tubing drilling that includes tools for drilling and for well stimulation. The bottom hole assembly (BHA) 100 is coupled to a coiled tubing 102 by a tubing end connector 104. The coiled tubing 102 is secured by a surface structure. The BHA 100 includes a check valve 106 that controls the directionality of fluid flow through the coiled tubing and into various components of the BHA 100. For example, the check valve 106 will allow the fluid flow in one direction and block fluid flow in the opposite direction. In this disclosure, it can prevent fluid flow back to tubing 102. The BHA 100 can include a jar 108 for delivering an impact load to the BHA 100, for example, when BHA 100 gets stuck.

Figure 1B:
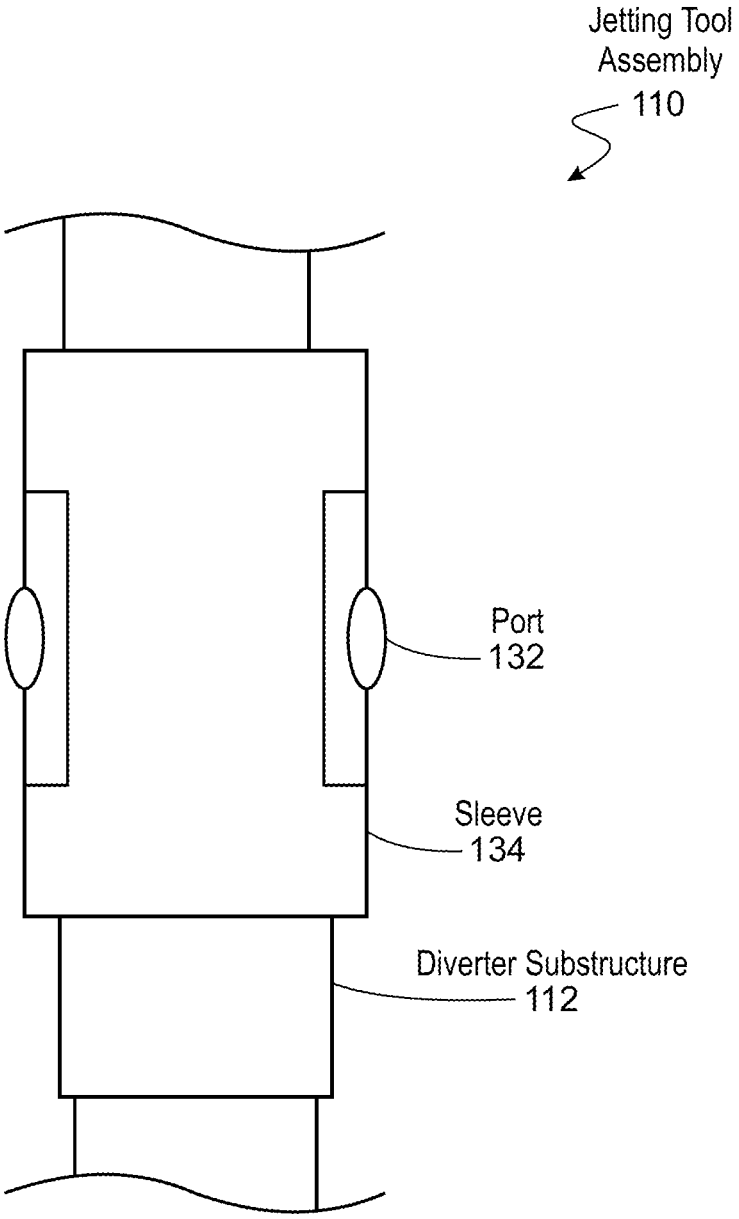
FIG. 1B is a schematic diagram of an example jetting tool for the bottom hole assembly of FIG. 1A, in accordance with embodiments of the present disclosure.

The BHA 100 includes a jetting tool assembly 110. FIG. 1B is a schematic diagram of an example jetting tool assembly 110 for the bottom hole assembly of FIG. 1A, in accordance with embodiments of the present disclosure. The jetting tool assembly 110 includes a port 132 and sleeve 134. The jetting tool assembly 110 provides a way for pinpoint stimulation of the well. The jetting tool assembly 110 can abrasively perforate multiple stages in the lateral section drilled by UBCTD on a single run, and without the need for explosives. This jetting tool 110 process is efficient for stimulation open hole. The jetting tool assembly facilitates additional services to be combined into the downhole intervention, such as well cleanouts, acidizing, or other services without the need for additional coiled tubing runs.

The jetting tool assembly 110 uses jet ports 132 to focus a fluid slurry into a flow stream capable of cutting through the rock. The jetting tool assembly 110 can include multiple ports 132 arranged radially and axially. The exact port layout will be dependent on the horizontal part orientation and hydraulic fracture propagation direction, which can be predicted based on the mechanics principles. This arrangement allows the jetting tool assembly 110 to jet fluid in different directions radially to perforate and fracture the wellbore at different radial locations. The sleeve 134 can be used to cover certain ports 132. The sleeve 134 can be engaged to cover the ports 132 during movement of the BHA 100 to make sure the ports 132 are clean for operation. The sleeve 134 can also be used to selectively cover or uncover certain ports 132. Sleeve 134 can be engaged or disengaged using a hydraulic or mechanical actuator.

The jetting tool assembly 110 can use hydrajetting to create perforations, cracks, and fractures in the rock formation. Hydrajetting can be used, firstly, to inject fluid to form perforations in the rock formation. This fluid, referred to herein as a perforation fluid, can be abrasive or non-abrasive. The perforation fluid can be jetted at high speed to perforate the rock formation at a measured depth and or at a determined lateral location in the wellbore. A perforation is a hole in the rock formation that is created to help facilitate fracturing. Then through these created perforations, hydraulic fracture can be easily initiated, which is described in more detail below.

The BHA 100 can include a drilling bit 122 that the BHA uses to drill the wellbore 404. During the same downhole run, the BHA 100 can perform perforation, fracturing, and stimulation. During the fracturing process, the jetting tool assembly 100 is positioned within wellbore 404 at a location where a fracture is to be generated. The perforation fluid is then jetted through port 132, against the formation at a high speed sufficient to erode the formation and create a desired perforation cluster. The perforation cluster will be used to initiate a hydraulic fracture during injecting main pump schedule. The fluid can be water or slick water, at the normal room temperature.

In certain situations, a proppant can be added into the fracturing fluid, which is transported and placed over the fracture surface area. The proppant can be sand grains, ceramic or bauxite or other man-made grains. The proppant functions to prevent the fractures from closing and provides conductive channels in the formation for oil/gas flowing into the wellbore. The presence of proppant can increase the erosive effect of the jetting fluid for perforating cased hole. The proppant can be added for the fracturing fluid, and in some cases, can be added in the perforation fluid.

Returning to FIG. 1A, the BHA 100 also includes a diverter substructure (sub) 112. The diverter sub 112 can be positioned down-string of the jetting tool assembly 110. In the embodiment shown in FIG. 1A, the diverter sub 112 is positioned down-string and adjacent to the jetting tool assembly 110. The diverter sub 112 is structured to selectively block fluid flow through the drilling motor and bit after drilling the lateral. Additionally, the diverter sub 112 when isolating the drilling bit, can force fluid flow to the jetting tool assembly 110 only for jetting high speed fluid. In embodiments, the diverter sub 112 can isolate the drilling bit and diverting the fluid to down-hole tool areas of the BHA 100.

BHA 100 also includes an electric release 114. Electric release 114 can be used to decouple down-string tools and subs from tools and subs up-string, relative to the electric release 114. The electric release 114 can be actuated electronically from a surface command. For example, if down-string tool or sub gets stuck, the down-string tool or sub can be decoupled from the rest of the BHA 100, allowing the BHA 100 to be removed from the wellbore.

BHA 100 includes a measurement-while-drilling sub 116 (MWD 116). MWD 116 can include various tools for data collection during drilling. MWD 116 can provide wellbore position, directional data, and real-time drilling information. MWD 116 can include a gyroscope, magnetometer, accelerometer, etc. to determine borehole inclination and azimuth during the actual drilling. The data is then transmitted to the surface. MWD 116 can include tools for determining formation properties, such as gamma ray, pressure sensors, etc. As shown in FIG. 1, a separate gyroscope unit 118 can be used for directional measurements.

Generally, the MWD 116 can be used to drill the wellbore, and can also be used to identify locations in the formation (e.g., along or proximate the landing zone) where fractures are to be generated. This information can be used to reposition the BHA 110 (and the jetting tool assembly 110 specifically) to generate perforations and fractures, and for stimulating the well.

The BHA 100 includes a drilling bit 122 that is driven by a motor 120. The motor can include a bent sub for directional drilling. The drilling bit 122 can be driven by a drilling fluid.

Figure 2:
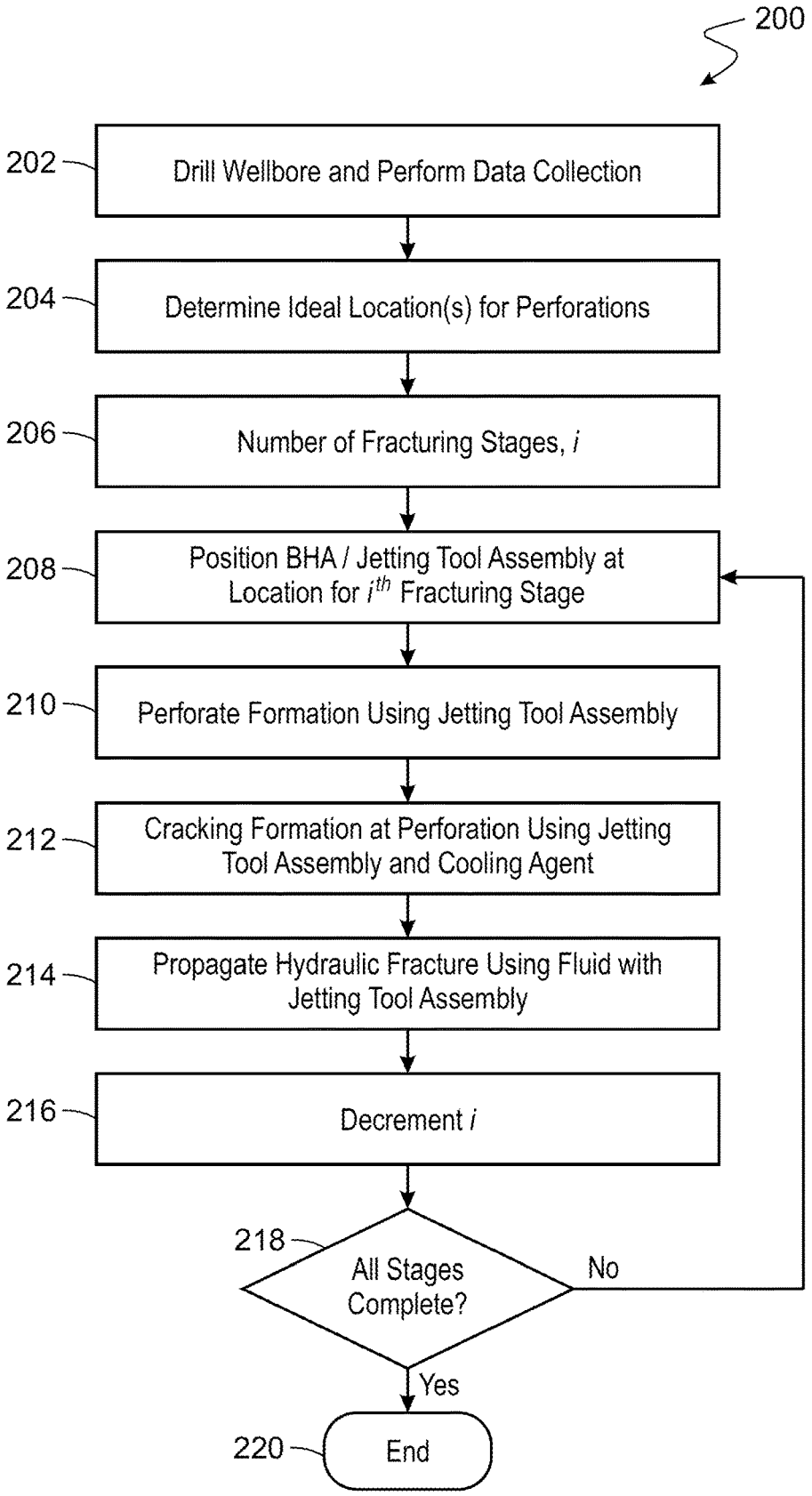
FIG. 2 is a flowchart of an example of a method 200 for stimulating a well created by underbalanced coil tubing drilling, according to some implementations of the present disclosure.

For UBCTD wells, the hole diameter is relatively small. This disclosure describes a fracturing process for such UBCTD wells, that factors in a desire for a single downhole run for drilling and stimulation. For this reason, BHA 100 integrates drilling and stimulation tools together, as shown in FIGS. 1A-B. Once the drilling is completed, the BHA 100 will be repositioned downhole to proceed to the fracturing phase. FIG. 2 illustrates a detailed jetting-based fracturing procedure after the UBCTD well is drilled. FIG. 2 is a flowchart of an example of a method 200 for stimulating a well created by underbalanced coil tubing drilling, according to some implementations of the present disclosure. For clarity of presentation, the description that follows generally describes method 200 in the context of the other figures in this description. However, it will be understood that method 200 can be performed, for example, by any suitable system, environment, software, and hardware, or a combination of systems, environments, software, and hardware, as appropriate. In some implementations, various steps of method 200 can be run in parallel, in combination, in loops, or in any order. Reference to FIGS. 4-8 will be made throughout the discussion of FIGS. 2-3.

Figure 4:
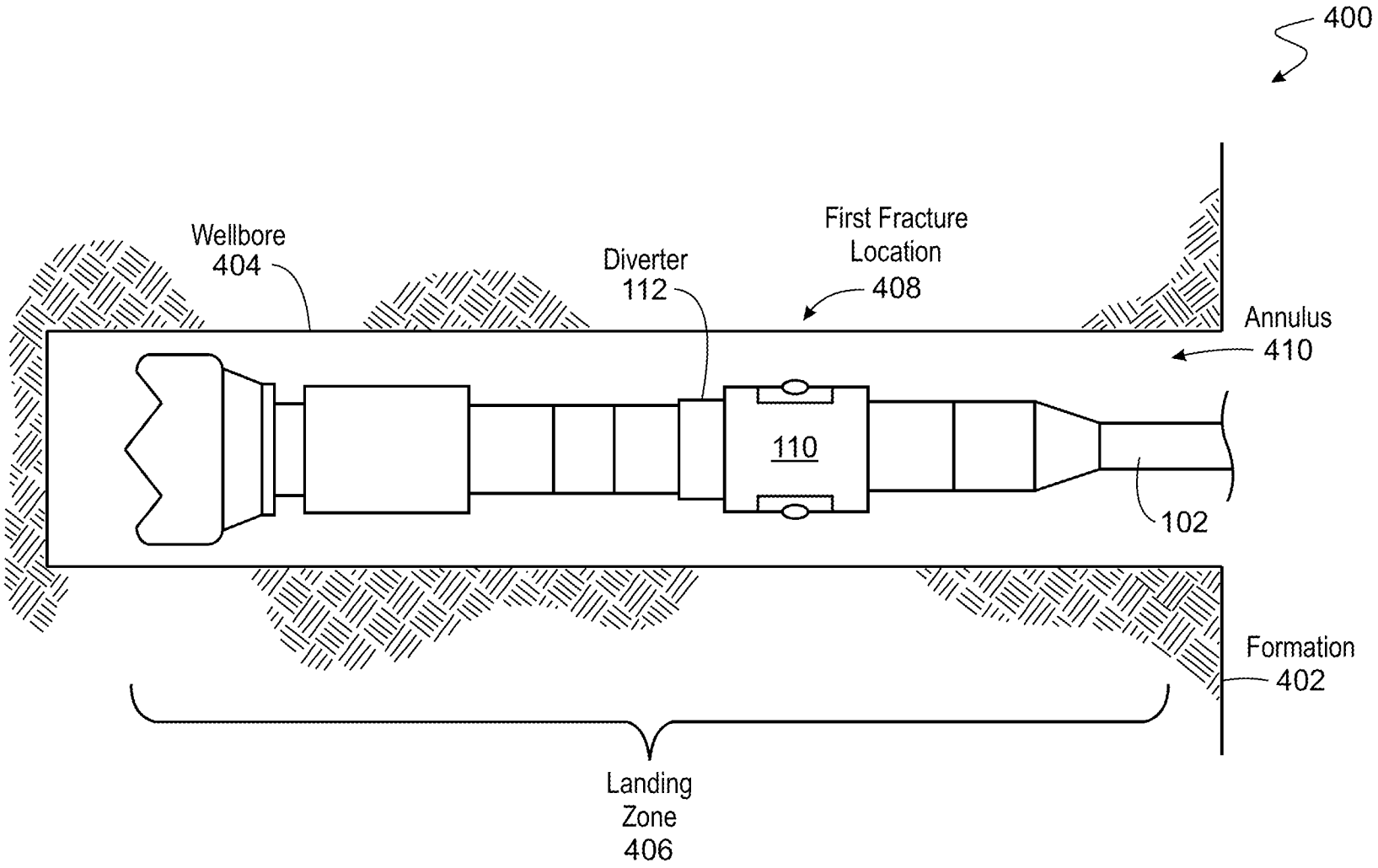
FIG. 4 is a schematic diagram illustrating a landing zone of the wellbore created using the bottom hole assembly in accordance with embodiments of the present disclosure.

At (202), as a preliminary matter, the BHA 100 performs drilling the wellbore through a formation. The result of drilling the wellbore is shown in FIG. 4. The wellbore (shown as wellbore 404 in FIG. 4) penetrates through a landing zone 406. The landing zone 406 here refers to formation layer along the wellbore 404 where stimulation will be conducted in the formation 402. During the drilling process, data about the formation is collected. For example, a drilling report is transmitted to the surface facility, as well as a final well trajectory, formation tops, etc. Other information can also be collected. The 3D geomechanics model and rock quality along the landing part are used for determining the locations for the perforations, as well as for determining the number of fracturing stages.

FIG. 4 is a schematic diagram 400 illustrating a landing zone 406 of the wellbore 404 created using the bottom hole assembly 100 in accordance with embodiments of the present disclosure. The BHA 100 and coiled tubing 102 within the wellbore define an annulus 410, through which fluid can be injected downhole for stimulation (described later). These features are common between FIGS. 4-8, which illustrate various stages of the stimulation process. FIG. 4 also shows an example first fracturing location 408. This first location is shown to be offset from the resting position of the jetting tool assembly 110 to illustrate that the first location 408 is determined using information obtained during drilling or from 3D geomechanics model, described next.

At (204), a computer at the surface facility (or elsewhere) can determine the ideal fracturing locations (here, fracturing locations refers to the locations in the wellbore where perforations and fracturing will occur). The computer can receive information from MWD and 3D geomechanics model to determine the ideal fracture locations, including the number of fracture stages. The computer can determine the perforation locations based on the required breakdown pressure for initiating hydraulic fracture from the wellbore and consider the diagenetic rock typing as well.

Figure 3:
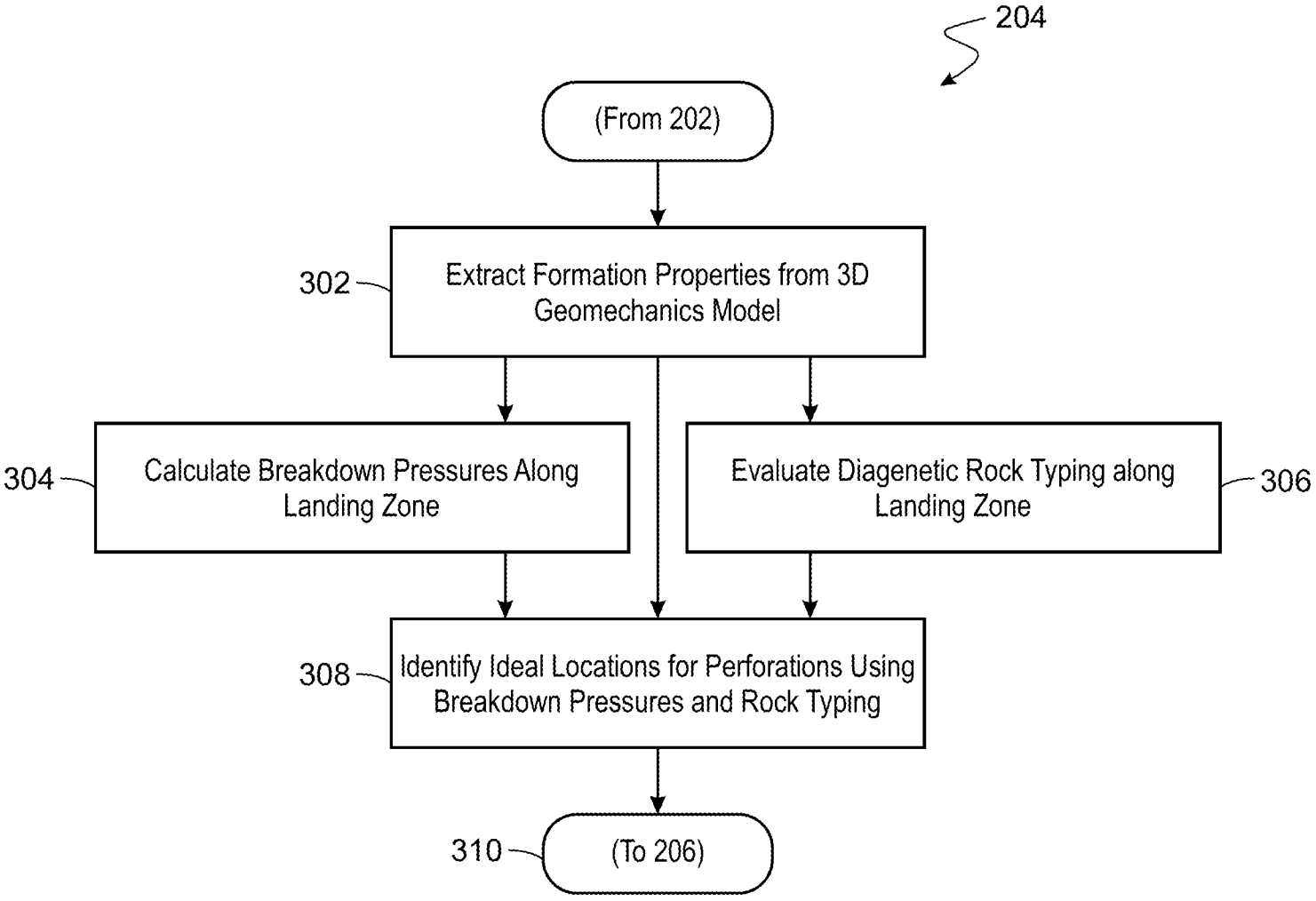
FIG. 3 is a flowchart of an example of a method 300 for identifying perforation an fracture locations at a landing zone of the wellbore, according to some implementations of the present disclosure.

FIG. 3 is a flowchart of an example of a method 300 for identifying perforation locations along the landing part of the wellbore, according to some implementations of the present disclosure. For clarity of presentation, the description that follows generally describes method 300 in the context of the other figures in this description. However, it will be understood that method 300 can be performed, for example, by any suitable system, environment, software, and hardware, or a combination of systems, environments, software, and hardware, as appropriate. In some implementations, various steps of method 300 can be run in parallel, in combination, in loops, or in any order. FIG. 3 shows a workflow for identifying locations for perforation, which are taken after drilling UBCTD wells and after data collection (step (202) in FIG. 2.

At (302), the computer on the surface extracts, from the 3D geomechanics model, using the final lateral well trajectory to extract formation properties, which include in-situ stresses and maximum horizontal stress direction.

At (304), the computer can calculate the required breakdown pressure for fracture initiation of the formation from the open wellbore in the landing zone. In addition, the optimum perforation directions along the landing part wellbore can also be determined. At (306), the computer can determine the diagenetic rock typing along the wellbore in the landing zone.

At (308), the ideal perforation locations are identified based on the required breakdown pressure information and the diagenetic rock typing. The ideal locations for perforation will be the locations that require relative lower breakdown pressure for fracture initiation and have good rock quality. In addition to the perforation locations, the number of fracturing stages is also determined (e.g., the ideal locations can indicate the number of fracture stages). After determining the locations for the perforations, the process can return to (206).

In addition, the pump schedule/injection schedule can be optimized through hydraulic fracturing modeling, which can account for the interactions between hydraulic fractures and natural fractures. This optimization can help achieving desired stimulation results.

At (206), the process can track the number of fracture stages, indexed as i.

Figure 5:
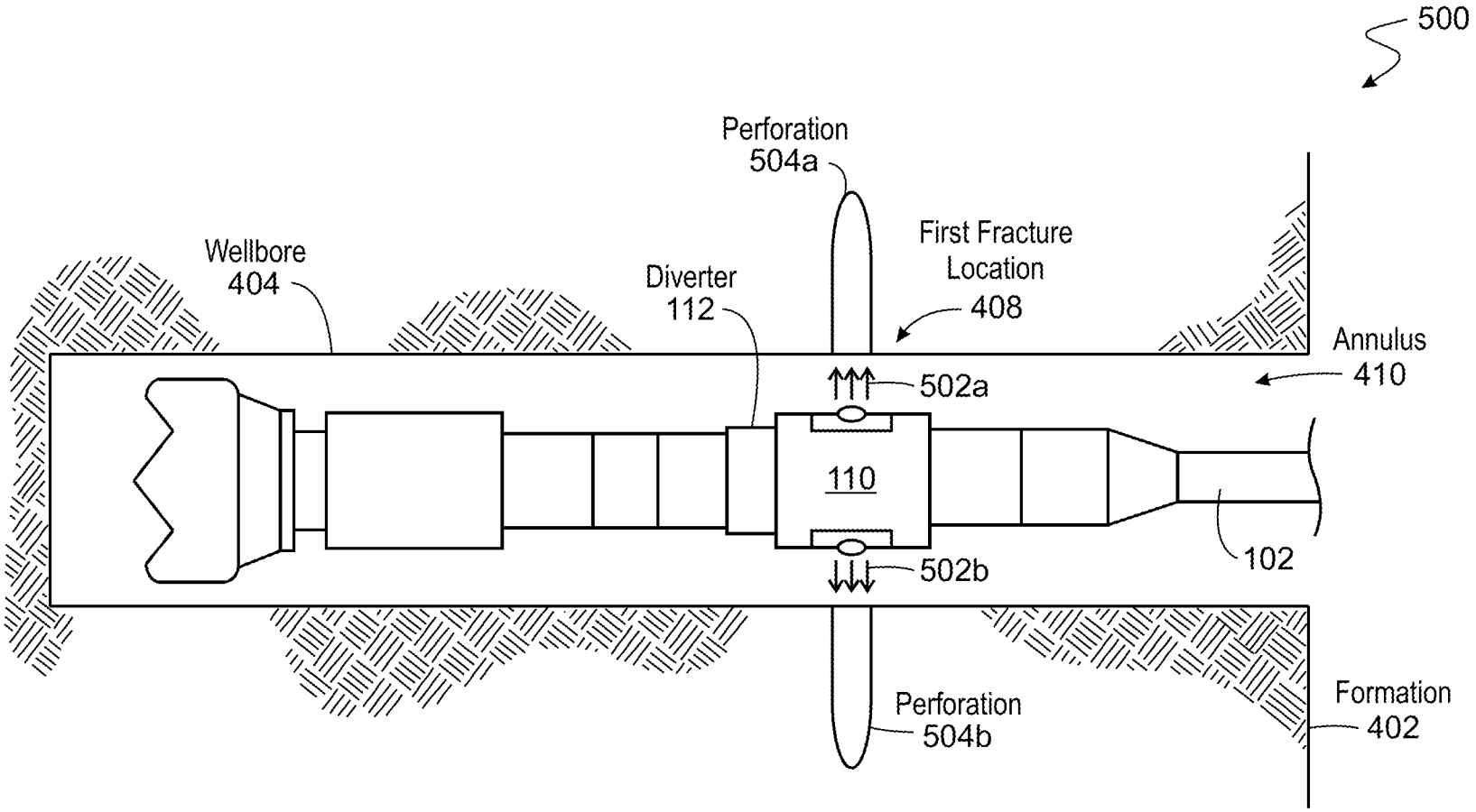
FIG. 5 is a schematic diagram illustrating creating a perforation at a first location in the landing zone using the bottom hole assembly in accordance with embodiments of the present disclosure.

At (208), the computer can reposition the BHA 100 (or instruct the BHA 100 to be repositioned) so that the jetting tool assembly is in position to begin the perforation process at the first fracturing location. A controller that controls the coiled tubing for example can retract or extend the coiled tubing to perform the repositioning. FIG. 4 shows the first fracturing location 408 relative to the jetting tool assembly 110. FIG. 5 shows that the BHA 100 has been repositioned so that the jetting tool assembly 110 can create a perforation at the first ($i^{th}$) fracturing location 408.

At (210), the perforations can be generated. For example, a computer can signal the jetting tool assembly 110 to perform perforation at the first fracturing location 408. For open hole multistage fracturing (MSF), it can be difficult to initiate transverse fractures from near the wellbore at the beginning whether the lateral section is aligned at the minimum horizontal stress direction or maximum horizontal stress direction. The reason is bottom hole hydraulic fluid pressure cannot be effectively applied to stretch the near wellbore in the axial direction even though the bottom hole pressure can be very high. Very little tensile stress can be generated for initiating transverse fracture. For this reason, perforations are generated for an easier fracture initiation especially for a higher chance to initiating transverse fracture, which can improve the fracture initiation issue for open hole. The hydraulic fracture propagation direction will be dependent on the well orientation in subsurface and maximum horizontal stress direction. In some situation, longitudinal hydraulic fracture will be created. Once the UBCTD lateral is drilled and the ideal fracture locations are determined, hydrajetting perforation will be conducted.

The sleeve 134 of the jetting tool assembly 110 can be moved to expose the port 132. A perforation fluid can be pumped through the coiled tubing 102 and can be jetted from the port 132 of the jetting tool assembly 110. The fluid can be at a normal temperature (e.g., the fluid is not treated for temperature) for perforation. FIG. 5 is a schematic diagram 500 illustrating creating a perforation cluster at a first fracturing location 408 in the landing zone 406 using the bottom hole assembly 100 in accordance with embodiments of the present disclosure. A perforation 504*a* can be generated at the first fracturing location along the wellbore in the landing zone 406. A coplanar perforation 504*b* can also be generated at the same time. A single perforation can be generated or a perforation cluster, which can include coplanar perforations. Thus a perforation cluster using hydrajetting is coplanar (composed of several perforations aligning at the preferred direction at the same coplanar, 504*a* and 504*b*), which is good for initiating fracture.

The jetting tool assembly 110 utilizes jet orifices to focus the perforation fluid (e.g., an acid, slickwater, or other fluid slurry) into a flow stream capable of cutting through rock. The jetting tool assembly 110 works based on the Bernoulli equation as follows:

$$\frac{1}{2}\rho V_1^2 + p_1 + \rho g Z_1 = \frac{1}{2}\rho V_2^2 + p_2 + \rho g Z_2 = C,$$

where V is fluid velocity, p is fluid pressure, ρ is fluid density, g is gravitational acceleration. The Bernoulli equation is stated in terms of universally valid for conservation of energy and neglect the friction loss. Based on the Bernoulli equation, increasing fluid flow velocity decreases the fluid pressure. For the jetting tool assembly setting downhole, the pressure inside the jetting tool assembly 110 is much higher than the pressure inside the annulus 410, which cause the jetting velocity to be very high. Thus the resulted kinetic energy is used to cut rock for perforation purpose before injecting main pump schedule.

As shown in FIG. 5, the nozzles of the jetting tool assembly 110 are pinpointed along the optimal perforation direction at a measured depth within wellbore and fluid is then jetted through the nozzles against the formation at a high speed to erode the formation and create a perforation cluster therein (shown as jetted fluid 502*a* for forming perforation 504*a* and jetted fluid 502*b* for forming coplanar perforation 504*b*). The jetting fluid mechanism is based on high kinetic energy to cutting the rock formation. Perforation using fluid jetting practically alleviates the negative effects of blasting loads on the formation, whereas the resultant holes are much larger than using shaped charges under similar conditions. The perforation shape can be more controlled than using shaped charge or blasting loads. Notably, hydrajetting perforation is suitable for perforating a small open hole drilled by UBCTD. Traditional blasting is difficult to operate in the small downhole size.

For perforations, normal temperature fluid (i.e., the fluid is not heated or cooled prior to use in hydrajetting) is jetted to cut the rock for the desired perforation shape (to include the depth of the perforation). The jet ports 132 are pinpointed at the optimal perforation directions calculated as stated in FIG. 3. Theoretically there are two directions with phase difference of 180°, which require the lowest breakdown pressure for hydraulic fracture initiation at each measured depth. This suggests using at least two ports pointing at the two directions based on the theoretical calculation. The advantage of using hydrajet technology is to generate perforations that are coplanar or substantially coplanar (e.g., perforation 504*a* is coplanar or substantially coplanar with perforation 504*b*). This can avoid the near wellbore tortuosity and alleviate screen-out issue as well. The conventional perforation method using blast or shape charges has to be designed with spiral order in the borehole axial direction with phase difference of 60°, which can easily lead to near wellbore tortuosity.

Figure 6:
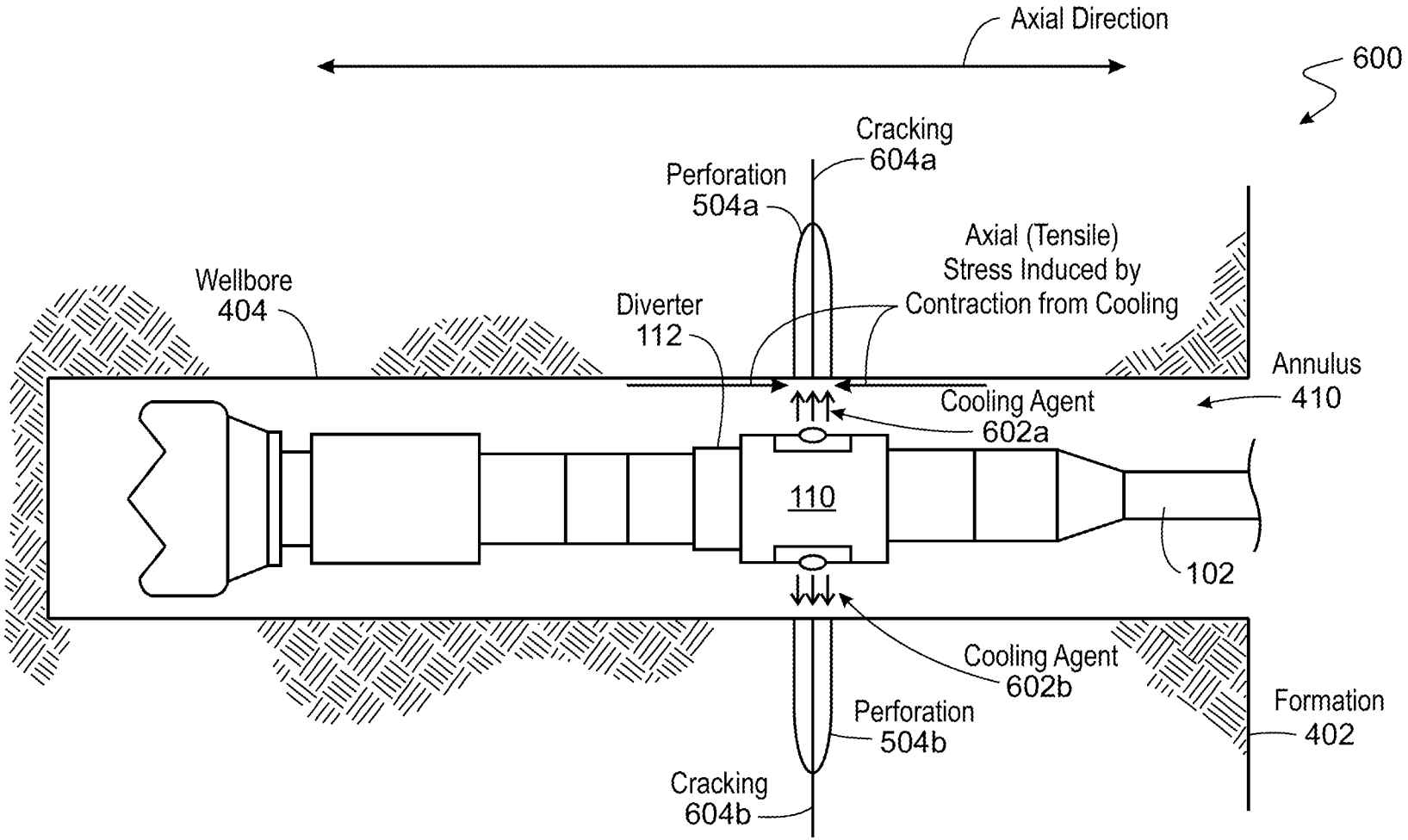
FIG. 6 is a schematic diagram illustrating creating a crack due to thermal cooling in the formation through the perforation using a cooling agent applied by the bottom hole assembly in accordance with embodiments of the present disclosure.

At (212), a cracking or sharp fracture can be developed from the perforations. For example, the computer can control a cooling agent to be pumped through the coiled tubing 102. The cooling agent can be jetted at a low speed through the jetting tool assembly 110 towards the perforation(s) area to create a further crack or sharp fracture. The mechanism is thermal cooling the wellbore area including the generated coplanar perforation cluster can induce additional axial tensile stress increasing around the weak perforation area via thermal contraction. This causes a sharp crack through perforation 504*a* (transverse relative to the wellbore). Similarly, for perforation 504*b* using cooling agent 602*b* to generate cracking 604*b*. FIG. 6 is a schematic diagram 600 illustrating creating a crack in the formation through the perforation using a cooling agent applied by the bottom hole assembly in accordance with embodiments of the present disclosure.

The additional axial tensile stress is defined as the tensile stress induced by cooling in the axial direction of wellbore. The cooling is aimed at reducing the breakdown pressure before injecting the main pump schedule of the hydraulic fracturing treatment. In some instances, the cooling agent can fill the coiled tubing annulus 410 quickly, which can quickly cool the targeted local area around the perforation 504*a* and 504*b*. Then thermal contraction will occur along the borehole axial direction and simultaneously induces tensile axial stress. The weakest area along the wellbore 404 will be the already perforated area, where further cracking or sharp fractures can be further initiated. Cracks/sharp fractures are shown as lines 604*a* for perforation 504*a* and line 604*b* for perforation 504*b*. This additional cracking or sharp fracture can aid fracture propagation after injecting the regular pump schedule (discussed later). The cooling time and injection rate of coolants can be controlled based on thermal-mechanical coupling model and considers thermal energy transfer and conversion. The cooling process will be stopped when the perforation area generates enough tensile stress for cracking, which can be predicted based on the thermal-mechanical coupling model. Generally, the cooling agent is jetted at as slow a rate as possible. The cooling agent can be liquid nitrogen or other similar fluid.

The cooling process will be executed within the fracturing stage interval, which should not be done for all stages simultaneously. For a reservoir, the reservoir temperature can be accurately measured through downhole logging device. The rock thermal properties include thermal expansion and thermal conductivity, specific heat can be accurately tested in lab. All these properties are known before simulating the cooling process, which will be accounted for the cooling agent design and injection.

Figure 7:
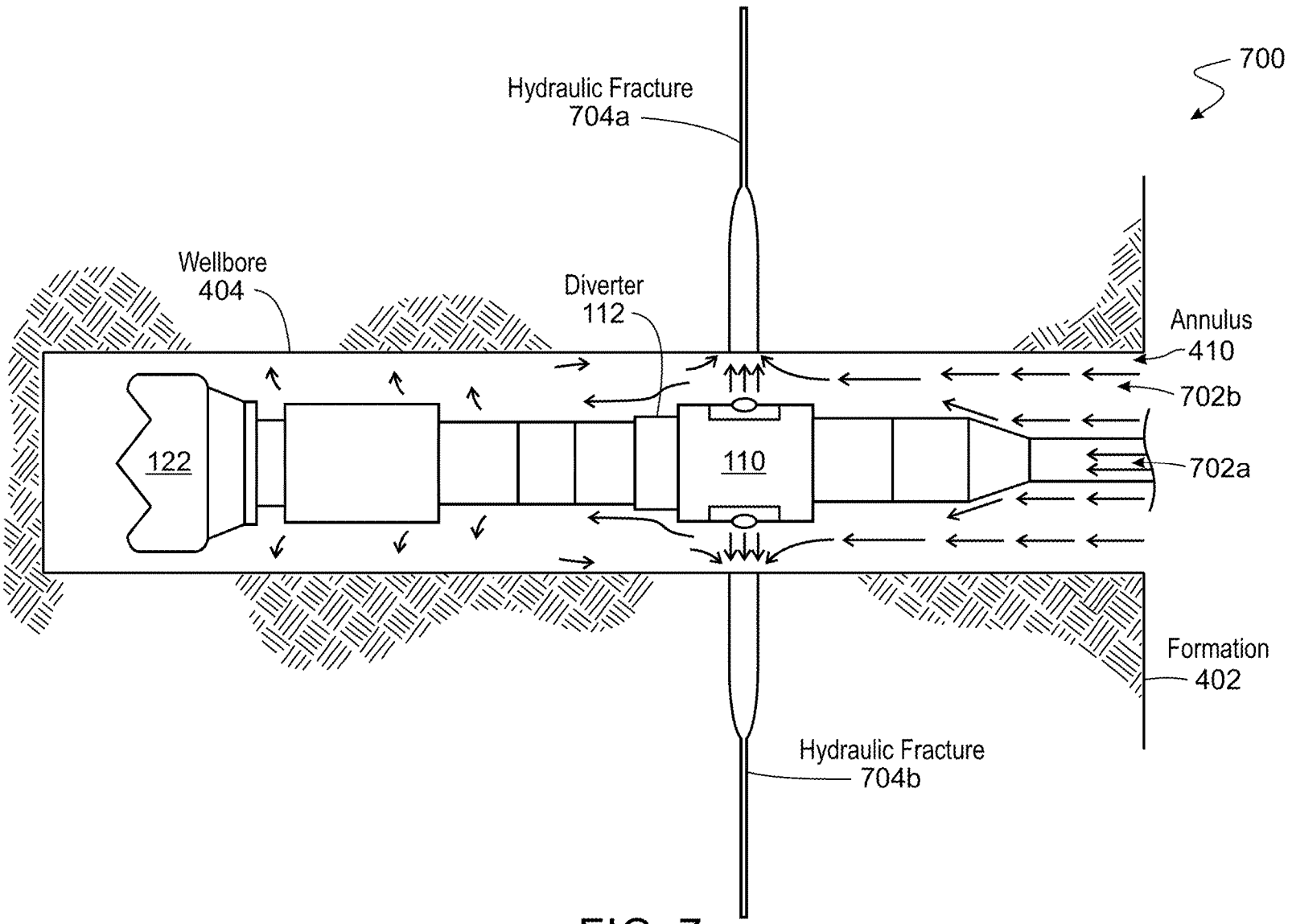
FIG. 7 is a schematic diagram illustrating creating hydraulic fractures in the formation using the bottom hole assembly and using the annulus in accordance with embodiments of the present disclosure.

At (214), the hydraulic fractures are propagated. FIG. 7 is a schematic diagram 700 illustrating creating a hydraulic fracture in the formation using the bottom hole assembly and using the annulus in accordance with embodiments of the present disclosure. FIG. 7 shows fluid injection to propagate a hydraulic fracture deep into the reservoir formation from wellbore 404. The fracturing fluid 702*a*, which can be slickwater (with or without a proppant) for example, can be pumped through the coiled tubing 102 to be jetted through the perforation to form or extend the hydraulic fracture 704*a* (and 704*b* if applicable-fractures can propagate from the perforations 504*a*, 504*b* and then merge into a connected fracture, and propagates deeper into the reservoir). In some instances, the fluid 702*b* can be pumped through the annulus 410. In FIG. 7, the fluid 702*a*, 702*b* is injected through the coiled tubing 102 and the annulus, respectively. This example scenario shows no stages or other features of the wellbore 404 downhole of the jetting tool assembly 110. Thus, no chemical plug is needed. However, as shown in FIG. 8, when performing the second stage or subsequent stage perforations and fracturing, a chemical plug 808 can be used to isolate the fractures already generated downhole, which allows for the fluid 702*a*, 702*b* to be injected through the coiled tubing 102 and annular 410, simultaneously.

At (216), the number of fracture stages is decremented (i−1), and at (218), if there are no more stages (i=0), then the process can end (220). If there are more stages (i>0), then the process can return to (208) to perform the next perforation at the next fracturing location. FIG. 8 is a schematic diagram 800 illustrating the creation of a second hydraulic fracture 806*a* in the landing zone 406 using the bottom hole assembly 100 in accordance with embodiments of the present disclosure. The BHA 100 is repositioned based on the second fracturing location 802 determined by the steps described in FIG. 3. The jetting tool assembly 110 can be covered by the sleeve 134 for movement, and the sleeve 134 can uncover the ports 132 for jetting operations.

Figure 8:
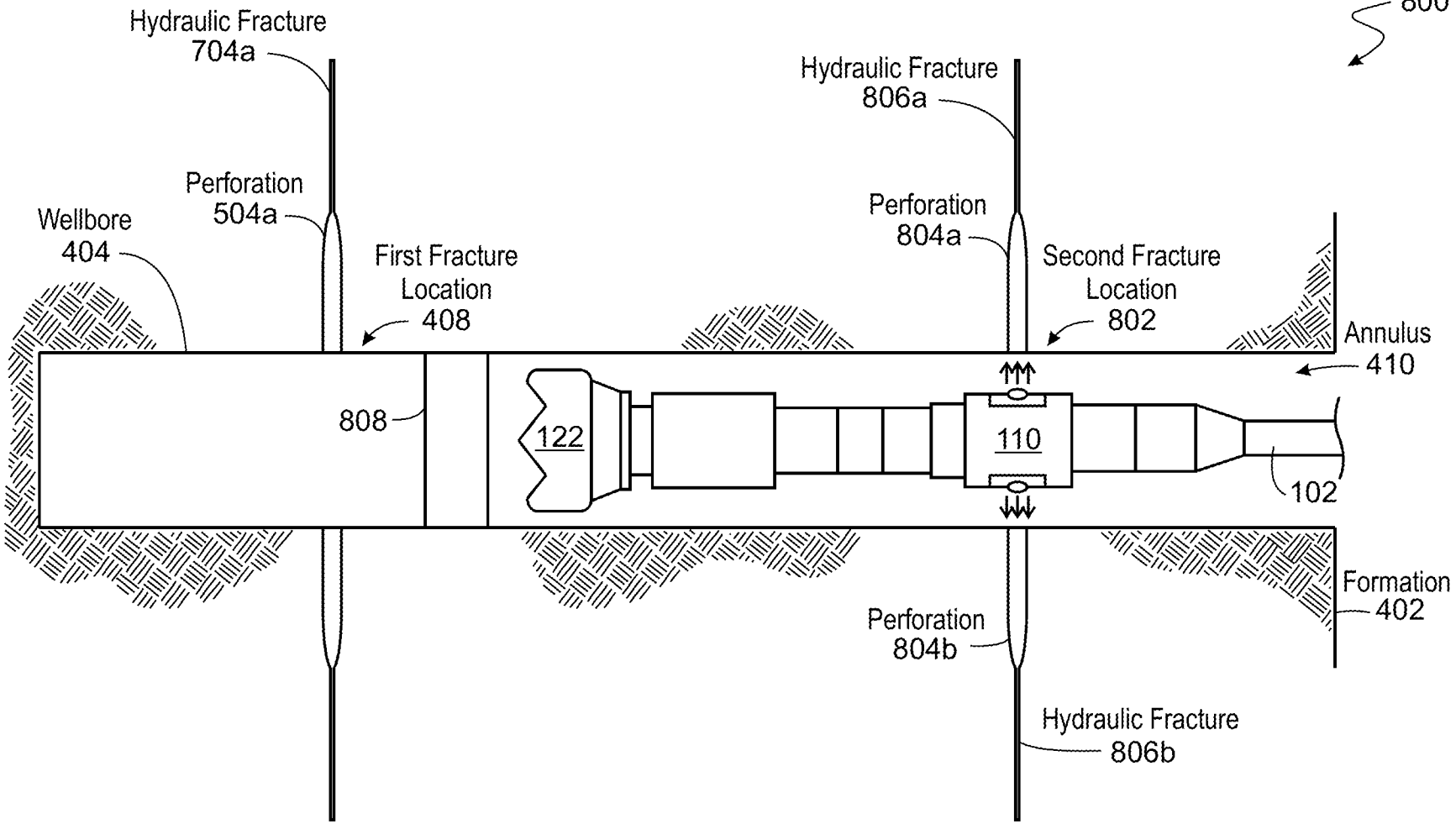
FIG. 8 is a schematic diagram illustrating the creation of a second hydraulic fracture in the landing zone using the bottom hole assembly in accordance with embodiments of the present disclosure.

As shown in FIG. 8, a chemical plug 808 can be used to isolate the first fracturing location 408 from the second fracturing location 802. For UBCTD wells, no packers will be installed above the jetting tool assembly 110. A chemical plug 808 is used to isolate the current fracturing stage with the previous fracturing stage. For this reason, fluid can be injected through coiled tubing 102 and annulus 410 simultaneously. This simultaneous injection of fluid through the coiled tubing 102 and annulus 410 can ensure fluid will mainly be used to propagate hydraulic fracture as well as stimulating the natural fractures distributed surround the near wellbore areas.

In addition, for multistage fracturing in the small hole, packers can increase the chance of a stuck tool scenario and are not viable for isolation in this case. Therefore, a chemical plug 808 can be injected at the designated location to isolate the current fracturing stage from the previous stage, as shown in FIG. 8. The chemical plug 808 can include a cross-linked poly-saccharide gel. The chemical plug 808 can provide a solid or substantially solid, impermeable gel to divert treatment fluids from the previously stimulated zones to the next zone of interest to be stimulated. The chemical plug 808 requires wellbore temperature of 180-350° F. (82-177° C.) as the cross-linker is designed to activate at higher temperatures. The chemical plug 808 will retain its solid state for 28 days with temperature of 180-230° F. and for 36 hours at temperatures above 350° F. (177° C.). The gel is designed to maintain a low viscosity at pumping temperatures and hydrates to form an impermeable gel when temperatures exceed 180° F. (82° C.).

After the chemical plug 808 is in place and solidified, the process can perform perforation (step 210), cracking/sharp fracture using cooling agent (step 212), and hydraulic fracture propagation (step 214) as described above.

Specifically, a perforation 804*a* can be generated at the second fracturing location 802 using a fracturing fluid at normal temperatures first, which generate the coplanar perforation cluster. Then a cooling agent can be slowly jetted to create a cracking or sharp fracture. Then the fluid of main pump schedule can be injected through coiled tubing 102 and through annulus 410 to propagate the main hydraulic fracture 806*a* from the coplanar perforation cluster. In other words, coplanar (or substantially coplanar) perforation cluster at fracturing location 802 will develop a hydraulic fracture and propagates deep into the reservoir. Coplanar perforations can initiate one fracture or multiple fractures that combine to form a single fracture. For example, fractures 804*a* and 804*b* can start as two fractures at the very beginning and quickly merge into one fracture and propagate into the reservoirs. A perforation cluster can include two or more substantially coplanar perforations, which can be arranged "symmetrically" around the wellbore at a measured depth. Perforations can be formed individually using a single port of the hydrajet, or perforations can be formed as perforation clusters using multiple ports of the hydrajet, which is dependent on the well orientation and tectonic stress regime.

Deep and tight gas reservoirs rely heavily on stimulation for good production. Using conventional drilling can face challenging issue on slow rate of penetration, fast drilling bit wear and hydraulic fracturing breakdown issue after drilling. Underbalanced coiled tubing drilling might be a good option for this kind of field development. However, some UBCTD wells still cannot produce naturally or have a very low production rate. Under this condition, the systems and techniques described herein integrate the drilling and fracturing process together in a single downhole run. Completing the stimulation during the drilling process is executed due to the low percentage of re-accessing the UBCTD lateral. Specifically, the bottom hole assembly, is designed with components to perform drilling and to perform perforation, fracturing, and stimulation. Secondly, a two-step perforation technique was designed, which utilizes hydrajet tool to jet normal temperature fluid to perforate the formation rock first, then slowly inject cooling agents to cool the perforation area (including surface surrounding the perforation) for generating additional sharp fracture tips. The sharp fracture tip will be very helpful for fracture propagation when the normal temperature main pump schedule is injected. Fractures can be made via main pump schedule, by introducing fluid to the wellbore through the annulus and/or coiled tubing. Overall this disclosure represents a new fracturing process for stimulating UBCTD wells in oil and gas industry.

Figure 9:
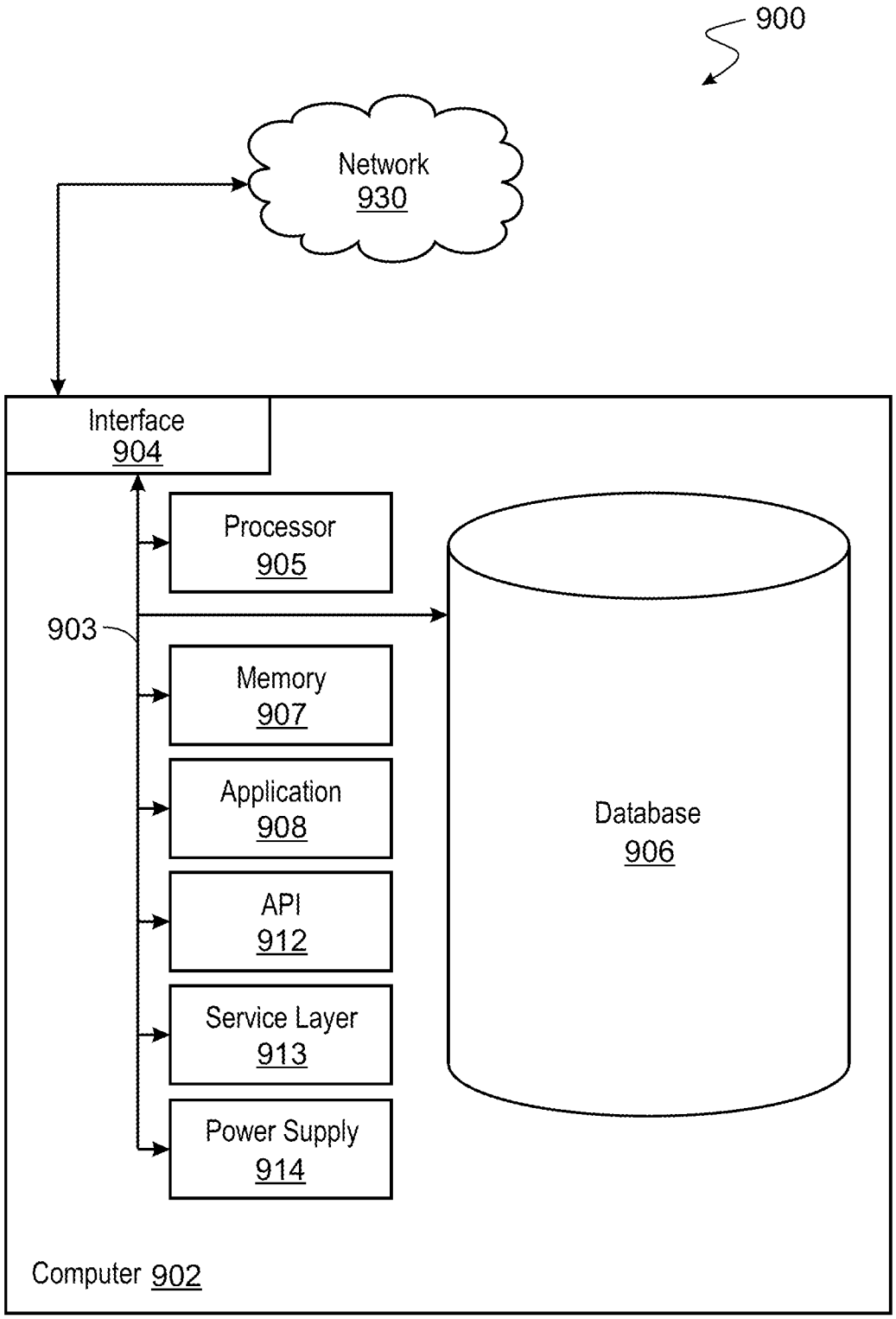
FIG. 9 is a block diagram illustrating an example computer system used to provide computational functionalities associated with described algorithms, methods, functions, processes, flows, and procedures as described in the present disclosure, according to some implementations of the present disclosure.

FIG. 9 is a block diagram of an example computer system 900 used to provide computational functionalities associated with described algorithms, methods, functions, processes, flows, and procedures described in the present disclosure, according to some implementations of the present disclosure. The illustrated computer 902 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 902 can include input devices such as keypads, keyboards, and touch screens that can accept user information. Also, the computer 902 can include output devices that can convey information associated with the operation of the computer 902. The information can include digital data, visual data, audio information, or a combination of information. The information can be presented in a graphical user interface (UI) (or GUI).

For example, the computer 902 can be located at the surface to receive data from the BHA 100 during and after drilling, which can be used to determine locations of fracture points in the landing zone. The computer 902 can also be used to control various operational stages, such as to control the location of the BHA 100 downhole, the operation of pumps for pumping fluids downhole for operating the drilling bit 122 and the jetting tool assembly 110, etc.

The computer 902 can serve in a role as a client, a network component, a server, a database, a persistency, or components of a computer system for performing the subject matter described in the present disclosure. The illustrated computer 902 is communicably coupled with a network 930. In some implementations, one or more components of the computer 902 can be configured to operate within different environments, including cloud-computing-based environments, local environments, global environments, and combinations of environments.

At a top level, the computer 902 is an electronic computing device operable to receive, transmit, process, store, and manage data and information associated with the described subject matter. According to some implementations, the computer 902 can also include, or be communicably coupled with, an application server, an email server, a web server, a caching server, a streaming data server, or a combination of servers.

The computer 902 can receive requests over network 930 from a client application (for example, executing on another computer 902). The computer 902 can respond to the received requests by processing the received requests using software applications. Requests can also be sent to the computer 902 from internal users (for example, from a command console), external (or third) parties, automated applications, entities, individuals, systems, and computers.

Each of the components of the computer 902 can communicate using a system bus 903. In some implementations, any or all of the components of the computer 902, including hardware or software components, can interface with each other or the interface 904 (or a combination of both) over the system bus 903. Interfaces can use an application programming interface (API) 912, a service layer 913, or a combination of the API 912 and service layer 913. The API 912 can include specifications for routines, data structures, and object classes. The API 912 can be either computer-language independent or dependent. The API 912 can refer to a complete interface, a single function, or a set of APIs.

The service layer 913 can provide software services to the computer 902 and other components (whether illustrated or not) that are communicably coupled to the computer 902. The functionality of the computer 902 can be accessible for all service consumers using this service layer. Software services, such as those provided by the service layer 913, can provide reusable, defined functionalities through a defined interface. For example, the interface can be software written in JAVA, C++, or a language providing data in extensible markup language (XML) format. While illustrated as an integrated component of the computer 902, in alternative implementations, the API 912 or the service layer 913 can be stand-alone components in relation to other components of the computer 902 and other components communicably coupled to the computer 902. Moreover, any or all parts of the API 912 or the service layer 913 can be implemented as child or sub-modules of another software module, enterprise application, or hardware module without departing from the scope of the present disclosure.

The computer 902 includes an interface 904. Although illustrated as a single interface 904 in FIG. 9, two or more interfaces 904 can be used according to particular needs, desires, or particular implementations of the computer 902 and the described functionality. The interface 904 can be used by the computer 902 for communicating with other systems that are connected to the network 930 (whether illustrated or not) in a distributed environment. Generally, the interface 904 can include, or be implemented using, logic encoded in software or hardware (or a combination of software and hardware) operable to communicate with the network 930. More specifically, the interface 904 can include software supporting one or more communication protocols associated with communications. As such, the network 930 or the interface's hardware can be operable to communicate physical signals within and outside of the illustrated computer 902.

The computer 902 includes a processor 905. Although illustrated as a single processor 905 in FIG. 9, two or more processors 905 can be used according to particular needs, desires, or particular implementations of the computer 902 and the described functionality. Generally, the processor 905 can execute instructions and can manipulate data to perform the operations of the computer 902, including operations using algorithms, methods, functions, processes, flows, and procedures as described in the present disclosure.

The computer 902 also includes a database 906 that can hold data for the computer 902 and other components connected to the network 930 (whether illustrated or not). For example, database 906 can be an in-memory, conventional, or a database storing data consistent with the present disclosure. In some implementations, database 906 can be a combination of two or more different database types (for example, hybrid in-memory and conventional databases) according to particular needs, desires, or particular implementations of the computer 902 and the described functionality. Although illustrated as a single database 906 in FIG. 9, two or more databases (of the same, different, or combination of types) can be used according to particular needs, desires, or particular implementations of the computer 902 and the described functionality. While database 906 is illustrated as an internal component of the computer 902, in alternative implementations, database 906 can be external to the computer 902.

The computer 902 also includes a memory 907 that can hold data for the computer 902 or a combination of components connected to the network 930 (whether illustrated or not). Memory 907 can store any data consistent with the present disclosure. In some implementations, memory 907 can be a combination of two or more different types of memory (for example, a combination of semiconductor and magnetic storage) according to particular needs, desires, or particular implementations of the computer 902 and the described functionality. Although illustrated as a single memory 907 in FIG. 9, two or more memories 907 (of the same, different, or combination of types) can be used according to particular needs, desires, or particular implementations of the computer 902 and the described functionality. While memory 907 is illustrated as an internal component of the computer 902, in alternative implementations, memory 907 can be external to the computer 902.

The application 908 can be an algorithmic software engine providing functionality according to particular needs, desires, or particular implementations of the computer 902 and the described functionality. For example, application 908 can serve as one or more components, modules, or applications. Further, although illustrated as a single application 908, the application 908 can be implemented as multiple applications 908 on the computer 902. In addition, although illustrated as internal to the computer 902, in alternative implementations, the application 908 can be external to the computer 902.

The computer 902 can also include a power supply 914. The power supply 914 can include a rechargeable or non-rechargeable battery that can be configured to be either user- or non-user-replaceable. In some implementations, the power supply 914 can include power-conversion and management circuits, including recharging, standby, and power management functionalities. In some implementations, the power-supply 914 can include a power plug to allow the computer 902 to be plugged into a wall socket or a power source to, for example, power the computer 902 or recharge a rechargeable battery.

There can be any number of computers 902 associated with, or external to, a computer system containing computer 902, with each computer 902 communicating over network 930. Further, the terms "client," "user," and other appropriate terminology can be used interchangeably, as appropriate, without departing from the scope of the present disclosure. Moreover, the present disclosure contemplates that many users can use one computer 902 and one user can use multiple computers 902.

The forgoing specification includes various embodiments, which include features in the following examples:

Example 1 is a bottom hole assembly for stimulating an underbalanced coiled tubing drilled well, the bottom hole assembly coupled to a coiled tubing, the bottom hole assembly that includes a drilling bit residing at the end of the bottom hole assembly; a hydrajetting tool up-string from the drilling bit, the hydrajetting tool to jet fluid to form a perforation in the formation, and thereafter to slowly jet a cooling agent to cool the wellbore area that includes the perforation; and a diverter substructure between the drilling bit and the jetting tool, the diverter substructure is used to prevent fluid from flowing to the drilling bit during the perforation.

Example 2 may include the subject matter of example 1, wherein the jetting tool is to jet a fracturing fluid towards the perforation to propagate a hydraulic fracture into the formation.

Example 3 may include the subject matter of any of examples 1-2, wherein the jetting tool includes a hydrajet assembly.

Example 4 may include the subject matter of example 3, wherein the hydrajet assembly includes a hydrajet port to eject fluid; and a hydrajet sleeve expose the hydrajet port to the wellbore formation.

Example 5 may include the subject matter of any of examples 1-4, wherein the coiled tubing is coupled to the bottom hole assembly to transmit the perforation fluid and the cooling agent to the hydrajetting tool.

Example 6 may include the subject matter of any of examples 1-5, and can also include a measurement while drilling (MWD) tool to take measurements of the formation during drilling, the measurements used, at least in part, to identify a location for forming a perforation in the formation.

Example 7 may include the subject matter of any of examples 1-6, wherein the drilling bit includes a diameter of less than 4 inches.

Example 8 is a method performed by a bottom hole assembly for stimulating an underbalanced coiled tubing drilled well, the bottom hole assembly coupled to a coiled tubing, the method including drilling a wellbore in a formation using the bottom hole assembly, the bottom hole assembly including a drilling bit at a bottom end of the bottom hole assembly for drilling the wellbore, a hydrajetting tool up-string from the drilling bit, and a diverter between the drilling bit and the hydrajetting tool; positioning the hydrajetting tool at a location in the wellbore to perform perforation of the formation; creating a perforation in the formation using the hydrajetting tool by jetting a perforation fluid at a first temperature towards the formation; creating a sharp fracture of the formation using the hydrajetting tool by slowly jetting a cooling agent at a second temperature into the wellbore area covering the perforation, the second temperature less than the first temperature; and propagating the fracture by injecting fracturing fluid downwards through the annulus and coiled tubing.

Example 9 may include the subject matter of example 8, wherein the perforation fluid and the cooling agent are delivered to the hydrajetting tool through the coiled tubing.

Example 10 may include the subject matter of any of examples 8-9, wherein the fracturing fluid for creating the fracture is delivered through the coiled tubing and the annulus formed by the coiled tubing and the wellbore.

Example 11 may include the subject matter of example 10, and can also include removing the bottom hole assembly from the (small) wellbore while maintaining the pressure of the fracturing fluid within the annulus to maintain borehole stability and in good shape.

Example 12 may include the subject matter of any of examples 8-11, and can also include, prior to creating the perforation, controlling the diverter to isolate the drilling bit from fluid flowing to the hydrajetting tool.

Example 13 may include the subject matter of any of examples 8-12, and can also include, after propagating the hydraulic fracture, moving the bottom hole assembly to a second perforation location up-hole from the just generated fracture; positioning the hydrajetting tool at a location for creating another coplanar perforation cluster in the wellbore formation; and forming a chemical seal in the wellbore downhole above the previous fracturing stage, the chemical seal to isolate the previous hydraulic fracture from fluids.

Example 14 may include the subject matter of example 13, and can also include creating a second perforation using the hydrajetting tool by jetting a perforation fluid towards the wellbore formation at the second perforation location; creating a second sharp fracture using the hydrajetting tool by slowly jetting a cooling agent into the wellbore including the perforation; and propagating the fracture by injecting fluid downwards through the annulus (between wellbore and tubing) and coiled tubing simultaneously.

Example 15 may include the subject matter of any of examples 8-14, and can also include determining the perforation locations using information about the formation.

Example 16 may include the subject matter of example 15, wherein the information about the wellbore comprises information obtained during drilling by a measurement while drilling (MWD) tool on the bottom hole assembly.

Example 17 may include the subject matter of example 15, wherein the information is obtained from a 3D geomechanics model of the wellbore.

Example 18 may include the subject matter of example 17, and can also include extracting information about the formation in a landing zone from the 3D geomechanics model; determining formation properties in the landing zone; and identifying each perforation location along the wellbore in the landing zone based on the formation properties and in-situ stresses.

Example 19 may include the subject matter of example 17, wherein identifying the location for each perforation comprises determining fracturing breakdown pressure along the wellbore in the landing zone; and identifying each perforation location based on the breakdown pressure.

Example 20 may include the subject matter of example 17, wherein identifying the location for each fracture comprises: evaluating a diagenetic rock typing at the landing zone; and identifying the location for each fracture based on the diagenetic rock typing.

Example 21 is a system for stimulating an underbalanced coiled tubing drilled well, the system comprising a bottom hole assembly comprising a drilling bit residing at the end of the bottom hole assembly, the drilling bit for forming a wellbore, a hydrajetting tool up-string from the drilling bit, the hydrajetting tool to jet a fluid to form a coplanar perforation cluster in the formation, and thereafter to slowly jet a cooling agent to cool the wellbore area that includes the coplanar perforation cluster, and a diverter substructure between the drilling bit and the hydrajetting tool, the diverter substructure is used to prevent fluid from flowing to the drilling bit during the perforating. A surface structure can control the bottom hole assembly to stimulate the well using the hydrajetting tool without extracting the bottom hole assembly after forming the wellbore.

Example 22 may include the subject matter of example 21, wherein the coiled tubing is coupled to the bottom hole assembly to transmit the perforation fluid and the cooling agent to the hydrajetting tool.

Example 23 may include the subject matter of any of examples 21-22, wherein the hydrajetting tool is to jet a fracturing fluid towards the perforation to propagate a hydraulic fracture into the formation.

Example 24 may include the subject matter of any of examples 21-23, wherein the hydrajetting tool comprises a hydrajet assembly.

Example 25 may include the subject matter of example 24, wherein the hydrajet assembly comprises a hydrajet port to eject fluid; and a hydrajet sleeve expose the hydrajet port to the wellbore formation.

Example 26 may include the subject matter of any of examples 21-25, wherein the coiled tubing is coupled to the bottom hole assembly to transmit the perforation fluid and the cooling agent to the hydrajetting tool.

Example 27 may include the subject matter of any of examples 21-26, and can also include a measurement while drilling (MWD) tool to take measurements of the formation during drilling, the measurements used, at least in part, to identify a location for forming a perforation in the formation.

Example 28 may include the subject matter of any of examples 21-27, wherein the drilling bit comprises a diameter of less than 4 inches.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A bottom hole assembly for stimulating an underbalanced coiled tubing drilled well, the bottom hole assembly coupled to a coiled tubing, the bottom hole assembly comprising:

a drilling bit residing at the end of the bottom hole assembly to drill a wellbore in a formation;

a hydrajetting tool up-string from the drilling bit, the hydrajetting tool configured to jet fracturing fluid to form a perforation in the formation and propagate a hydraulic fracture at the perforation, and to jet a cooling agent to cool an area in the wellbore that includes the perforation; and a diverter substructure between the drilling bit and the hydrajetting tool, the diverter substructure is used to prevent fracturing fluid from flowing to the drilling bit during stimulation of the underbalanced coiled tubing drilled well, wherein the bottom hole assembly is configured to be removable from the wellbore while maintaining a fluid pressure of the fracturing fluid within an annulus of the wellbore high enough to maintain stability of the wellbore, the annulus being defined by the bottom hole assembly and the coiled tubing, and the bottom hole assembly being configured to allow the fracturing fluid to be introduced into the wellbore through the annulus.

2. The bottom hole assembly of claim 1, wherein the hydrajetting tool comprises:

a hydrajet port to eject fluid; and a hydrajet sleeve to expose the hydrajet port to the wellbore formation.

3. The bottom hole assembly of claim 1, wherein the coiled tubing is coupled to the bottom hole assembly to transmit the fracturing fluid and the cooling agent to the hydrajetting tool.

4. The bottom hole assembly of claim 1, wherein a location of the bottom hole assembly downhole for generating the perforation is identified based on a breakdown pressure and rock typing.

5. The bottom hole assembly of claim 1, wherein the drilling bit comprises a diameter of less than 4 inches.

6. The bottom hole assembly of claim 1, wherein the fluid pressure of the fracturing fluid within the annulus of the wellbore is lower than a pore pressure of the formation.

7. The bottom hole assembly of claim 1, wherein a location of the perforation in the formation is determined using information about the formation, the information obtained from a 3D geomechanics model of the wellbore.

8. The bottom hole assembly of claim 7, wherein the location of the formed perforation in the formation is determined from the 3D geomechanics model of the wellbore by extracting in-situ stresses and formation properties along the wellbore from the 3D geomechanics model;

evaluating a diagenetic rock typing at a landing zone;

determining a fracturing breakdown pressure along the wellbore in the landing zone; and identifying the location of the perforation based on the in-situ stresses, the formation properties, the diagenetic rock typing, and the fracturing breakdown pressure.

9. A method performed by a bottom hole assembly for stimulating an underbalanced coiled tubing drilled well, the bottom hole assembly coupled to a coiled tubing, the method comprising:

drilling a wellbore in a formation using the bottom hole assembly, the bottom hole assembly comprising a drilling bit at a bottom end of the bottom hole assembly for drilling the wellbore, a hydrajetting tool up-string from the drilling bit, and a diverter between the drilling bit and the hydrajetting tool;

determining fracturing locations using information about the formation, the information obtained from a 3D geomechanics model of the wellbore;

positioning the hydrajetting tool at a location in the wellbore to perform perforation of the formation;

creating a perforation in the formation using the hydrajetting tool by jetting a perforation fluid at a first temperature towards the formation;

creating sharp fractures in the formation at the fracturing locations using the hydrajetting tool by jetting a cooling agent at a second temperature into a wellbore area covering the perforation cluster, the second temperature less than the first temperature; and propagating hydraulic fracture at the fracturing locations by injecting fracturing fluid downwards through an annulus and the coiled tubing simultaneously.

10. The method of claim 9, wherein the perforation fluid and the cooling agent are delivered to the hydrajetting tool through the coiled tubing.

11. The method of claim 9, further comprising removing the bottom hole assembly from the wellbore while maintaining a fluid pressure within the annulus high enough to maintain wellbore stability.

12. The method of claim 9, further comprising, prior to creating the perforation, controlling the diverter to isolate the drilling bit from fluid flowing to the hydrajetting tool.

13. The method of claim 9, further comprising, after propagating the fracture, maintaining sufficient fluid pressure within the annulus for moving the bottom hole assembly to a second location up-hole from the previous fracturing location;

positioning the hydrajetting tool at a location for creating another coplanar perforation cluster in the wellbore formation; and forming a chemical seal in the wellbore downhole above the previous fracturing stage, the chemical seal to isolate the previous fracture from fluids.

14. The method of claim 9, further comprising:

extracting in-situ stresses and formation properties along the actual wellbore from the 3D geomechanics model; and identifying each fracturing location along the wellbore in a landing zone based on the formation properties and in-situ stresses.

15. The method of claim 14, wherein identifying each fracturing location comprises evaluating a diagenetic rock typing at the landing zone.

16. The method of claim 15, wherein identifying the fracturing location comprises:

determining a required fracturing breakdown pressure along the wellbore in the landing zone; and identifying an ideal fracturing location based on the required fracturing breakdown pressure and the diagenetic rock typing.

17. A system for stimulating an underbalanced coiled tubing drilled well, the system comprising:

a computer configured to determine a position for a coplanar perforation of a wellbore by (i) extracting in-situ stresses and formation properties along the wellbore from a 3D geomechanics model, (ii) determining fracturing breakdown pressure along the wellbore in a landing zone, (iii) evaluating a diagenetic rock typing at the landing zone, and (iv) determining each fracturing location based on the fracturing breakdown pressure and the diagenetic rock typing;

a bottom hole assembly comprising:

a drilling bit residing at the end of the bottom hole assembly, the drilling bit for forming the wellbore, a hydrajetting tool up-string from the drilling bit, the hydrajetting tool to jet a fluid to create a coplanar perforation cluster in a formation at the determined position for the coplanar perforation, and thereafter to jet a cooling agent to cool a wellbore area that includes the coplanar perforation cluster, and a diverter substructure between the drilling bit and the hydrajetting tool, the diverter substructure being used to prevent fluid from flowing to the drilling bit during the perforating; and a surface structure to control the bottom hole assembly to stimulate the well using the hydrajetting tool without extracting the bottom hole assembly after drilling the wellbore.

18. The system of claim 17, the bottom hole assembly to propagate a hydraulic fracture through the perforation cluster by injecting a fracturing fluid to the wellbore through an annulus and through a coiled tubing.

19. The system of claim 17, wherein the drilling bit comprises a diameter of less than 4 inches.

* * * * *